US006160348A

United States Patent [19]

Choi

[11] Patent Number: 6,160,348

[45] Date of Patent: Dec. 12, 2000

[54] DC PLASMA DISPLAY PANEL AND METHODS FOR MAKING SAME

[75] Inventor: Kyung Cheol Choi, Mahwah, N.J.

[73] Assignee: Hyundai Electronics America, Inc., San Jose, Calif.

[21] Appl. No.: 09/080,561

[22] Filed: May 18, 1998

[51] Int. Cl.[7] ..... H01J 17/49

[52] U.S. Cl. ..... 313/584; 313/585; 313/586

[58] Field of Search ..... 313/581, 584, 313/585, 586, 587, 595, 596

[56] References Cited

U.S. PATENT DOCUMENTS

| | | | |
|---|---|---|---|
| 3,969,650 | 7/1976 | Chodil et al. | 315/169 |
| 4,130,778 | 12/1978 | Branston | 315/169 TV |
| 4,338,539 | 7/1982 | Littwin | 313/217 |
| 4,340,840 | 7/1982 | Aboelfotoh | 315/58 |
| 4,388,550 | 6/1983 | De Vries | 313/585 |
| 4,554,482 | 11/1985 | Kamegaya et al. | 313/582 |

(List continued on next page.)

FOREIGN PATENT DOCUMENTS

| | | |
|---|---|---|
| 56-61741 | 4/1981 | Japan . |
| 56-120051 | 9/1981 | Japan . |
| 57-050743 | 3/1982 | Japan . |

(List continued on next page.)

OTHER PUBLICATIONS

High–Resolution dc Color Plasma Display Panels; Rikusel Kohara, Kunio Inaguma, Yoshihiro Fujieda, Bunji Uchida, 1989 SID International Symposium Digest of Technical Papers, May, 1989, pp. 355–357.

A High–Resolution 19–in. 1024×768 Color ac PDP; H. Doyeux, J. Deschamps; 1995 SID International Symposium Digest of Technical Papers, May, 1995, pp. 811–814.

Performance Features of a 42–in.–Diagonal Color Plasma Display; T. Hirose, K. Karlya, M. Wakitani, A. Otsuka, T. Shinoda; 1996 SID International Symposium Digest of Technical Papers, May, 1996, pp. 279–282.

A Planar Single–Substrate AC Plasma Display with Capacitive Vias; George W. Dick, Martin R. Biazzo; IEEE Transactions on Electron Devices, vol. Ed–26, No. 8, Aug. 1979, pp. 1168–1172.

A Pulse Discharge Panel Display for Producing a Color TV Picture with High Luminance and Luminous Efficacy; Hiroshi Murakami, Ryuya Toyonaga; IEEE Transactions on Electron Devices, vol. Ed–29, No. 6, Jun. 1982, pp. 988–994.

(List continued on next page.)

*Primary Examiner*—Nineshkumar D. Patel
*Assistant Examiner*—Matthew J Gerike
*Attorney, Agent, or Firm*—Townsend and Townsend and Crew, LLP

[57] ABSTRACT

A colored DC plasma display panel having a plurality of sub-pixels organized in a matrix configuration. The color DC plasma display panel includes a first plate having a first substrate. A plurality of rows of cathodes are formed on the first substrate which include a plurality of holes therein spaced along each cathode row; preferably one hole for each sub-pixel. A dielectric layer covers the cathode rows and the substrate, and a plurality of holes are formed in the dielectric layer which align with the holes in the cathodes. The color DC plasma display panel further includes a second plate having a second substrate and a pluarility of rows of anodes formed on and extending along the length of the second substrate. The anodes reside in channels created between a pluarlity of rows of barrier ribs formed on the second substrate. The plasma display panel is formed by combining the first plate and the second plate so that the anodes rows on the second plate run substantially orthogonal to the cathode rows on the first plate. The sub-pixel cells are formed at or near where the anode rows cross the cathode rows and, in particular, where the anodes cross over or near the holes in the cathodes.

17 Claims, 7 Drawing Sheets

U.S. PATENT DOCUMENTS

| | | | |
|---|---|---|---|
| 4,963,114 | 10/1990 | Andreadakis | 445/25 |
| 5,164,633 | 11/1992 | Kim et al. | 313/581 |
| 5,182,489 | 1/1993 | Sano | 313/485 |
| 5,405,494 | 4/1995 | Nagano | 156/655 |
| 5,428,263 | 6/1995 | Nagano | 313/585 |
| 5,469,021 | 11/1995 | Lepselter | 313/582 |

FOREIGN PATENT DOCUMENTS

| | | |
|---|---|---|
| 61-024126 | 2/1986 | Japan . |
| 03084830 | 4/1991 | Japan . |
| 04169038 | 6/1992 | Japan . |
| 06196098 | 7/1994 | Japan . |
| 08222136 | 8/1996 | Japan . |
| 09139178 | 5/1997 | Japan . |

OTHER PUBLICATIONS

A 20–in. Color DC Gas–Discharge Panel for TV Display; Hiroshi Murakami, Takao Kuriyama, Masahiko Seki, Toshihiro Katoh, Hitoshi Nakagawa, Tamotsu Takahata, Akio Ishikawa, Kenichi Hirakata, Ryuichi Kaneko, Yoshimichi Takano, Tetsuo Sakai, Toshihiro Yamamoto, Yuukichi Miyata; IEEE Transactions on Electron Devices, vol. 36, No. 6, Jun. 1989, pp. 1063–1072.

Improvement in Lifetime of Color DC PDP; K. Maezawa; T. Akeyoshi, T. Mizutani, Y. Motoyama, M. Ushirozawa, T. Sakai; IEEE Transactions on Electron Devices, vol. 42, No. 5, May 1995, pp. 1007–1008.

Fig. 1
( Prior Art )
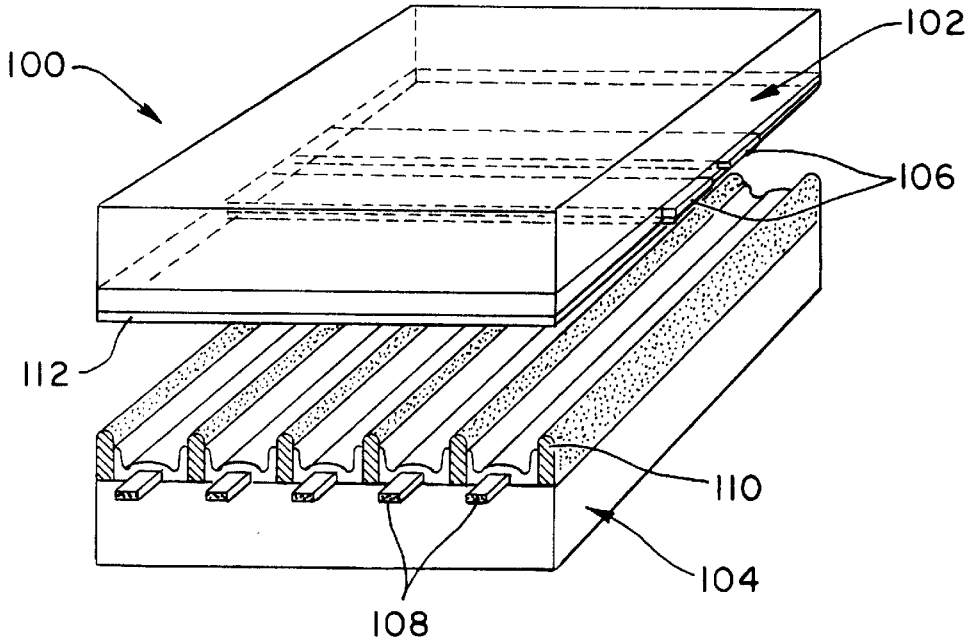
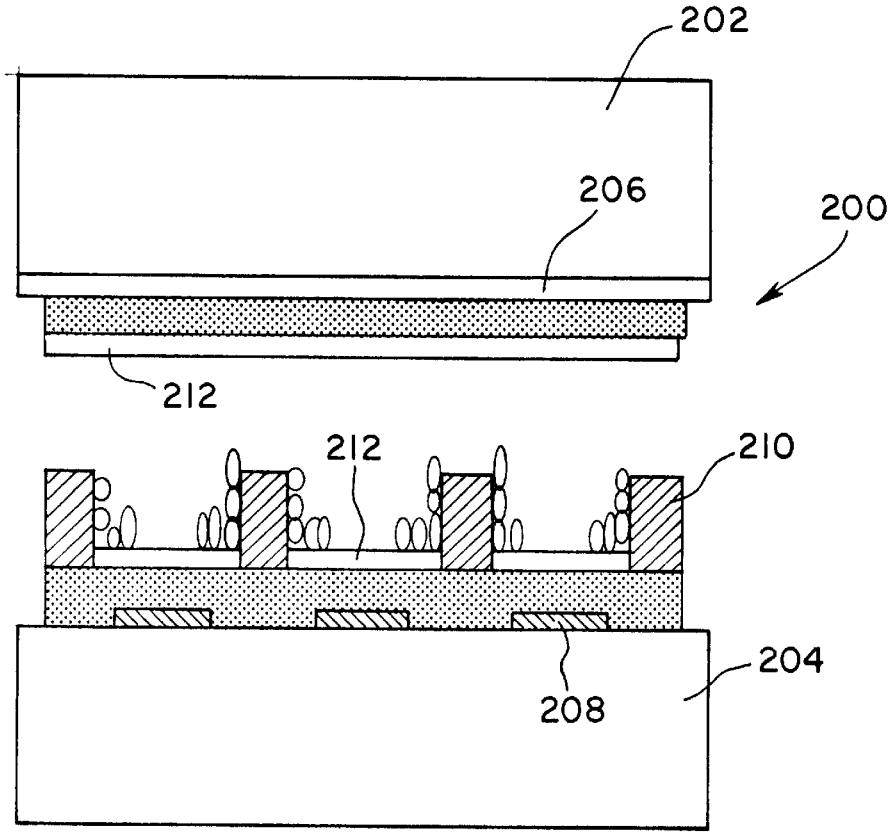
Fig. 2
( Prior Art )

DC PLASMA DISPLAY PANEL AND METHODS FOR MAKING SAME

BACKGROUND OF THE INVENTION

The present invention relates generally to a DC plasma display panel, and more specifically to a DC plasma display panel having holes in the cathodes for confining the plasma discharge within a discrete area of a plasma display panel cell. The present invention also relates to methods of making the DC plasma display panel of the present invention.

Color plasma display panels are considered by many to be the future of large-screen TVs, mainly because high quality CRT TVs tend to be bulky, and larger projection screen TVs typically have a poor image quality and limited viewing angles. In addition, the plasma display panels are ideal for the new digital HDTV format. Currently, there are two types of color plasma display panel devices; the DC plasma display panel and the AC plasma display panel. Both the AC-type and DC-type plasma display panels operate on the same general principles. That is, a gas discharge in each individual display cell (also known as a sub-pixel) generates ultraviolet light which excites a phosphor layer that fluoresces visible light. Differing phosphors are used for the red, green and blue primary colors, and full color moving images are obtained by modulating each primary color sub-pixel to one of typically 256 intensity levels at about 60 times a second.

The AC-type color plasma display panels typically are divided into two categories; surface discharge type AC plasma display panels, and opposed discharge type AC plasma display panels.

FIG. 1 shows a typical surface discharge type AC plasma display panel 100. AC plasma display panel 100 suitably comprises a front glass substrate 102, and a rear glass substrate 104. Front glass substrate 102 comprises a plurality of display or sustain electrodes 106, and rear glass substrate 104 includes a plurality of address electrodes 108 running substantially orthogonal to sustain electrodes 106. During operation, an AC voltage source is applied to sustain electrodes 106, and the fringing electromagnetic fields created by these excited electrodes reach into the gas in the plasma display panel cell and create a gas or plasma discharge. The discharge creates ultraviolet light which excites phosphor layers deposited on rear substrate 104. Rear substrate 104 also includes a plurality of barrier ribs 110 which separate each sub-pixel. The barrier ribs 110 prevent emitted light radiation in one display cell from seeping over into adjacent display cells, thus, reducing cross-talk between display cells.

FIG. 2 illustrates an opposed discharge type AC plasma display panel 200. As with the surface discharge type AC plasma display panel 100, opposed discharge type AC plasma display panel 200 comprises a front substrate 202 having a first electrode 206, and a rear substrate 204 having an second electrode 208 substantially orthogonal to first electrode 206. During operation of the opposed discharge type AC plasma display panel 200, an AC plasma discharge is generated between an electrically excited first electrode 206 and an electrically excited second electrode 208. The plasma discharge is generated on the surface of dielectric layer 210 and the ultraviolet light created by the discharge excites the phosphor on rear substrate 204. Opposed discharge type AC plasma display panel 200 also includes a plurality of barrier ribs 210 which help prevent the plasma discharges in each display cell from spreading to other cells in the plasma display panel.

One advantage of the AC-type plasma display panels is that they tend to have longer lifetimes than the DC-type displays because the AC-type displays include dielectric layers (112, 212) deposited on the substrates which help to protect the display electrodes from plasma discharge sputtering. However, the AC-type display panels have various limitations also. For example, even though both AC-type plasma display panels include barrier ribs for reducing cross-talk between display cells, the barrier ribs do not stop all the discharge bleeding between the cells, so the contrast ratio of the AC-type plasma display panels tends to be poor. In addition, dielectric layers (112, 212) which are deposited on the AC-type display panel substrates have a high capacitance, causing the AC-type plasma display panels to have a much slower response time than the DC plasma display panel counterparts.

Referring now to FIGS. 3 and 4, typical DC-type plasma display panels currently known in the art are shown. Specifically, FIG. 3 shows a monochrome DC plasma display panel, while FIG. 4 shows a color DC plasma display panel. As illustrated in FIG. 3, a typical monochrome DC plasma display panel 300 comprises a first substrate 302 having a plurality of rows of cathodes 306, and a second substrate 304 having a plurality of rows of anodes 308 running substantially orthogonal to cathodes 306. In DC plasma display panel 300, DC discharges are generated between electrically activated cathodes 306 and electrically activated anodes 308. Second substrate 304 of monochrome DC plasma display panel 300 further includes a plurality of barrier ribs 310 for separating anodes 308. The barrier ribs also help define the individual display cells of DC plasma display panel 300.

Color DC plasma display panel 400, as illustrated in FIG. 4, is similar to the monochrome DC plasma display panel of FIG. 3, except color DC plasma display panel 400 includes red, green and blue phosphors for generating the color display. As shown in FIG. 4, color DC plasma display panel 400 includes a front plate 402 having a plurality of cathodes 404 thereon. Color DC plasma display panel 400 further includes a rear plate 406 having a plurality of display anodes 408 thereon. Each display anode 408 is connected to a display anode bus lines 410 with a resistor 412. Covering anodes 408, anode bus lines 410, and resistors 412 is an insulating dielectric layer 414 which also covers substantially all of rear plate 406. Color DC plasma display panel 400 is made up of a large number of display cells 416 which are defined by barrier ribs 418, priming ribs 420, and cathodes 404. Within each display cell 416 is one of three types of phosphor 422; red, green or blue. Excitation of these three phosphors in a predetermined fashion creates the color display on front plate 402 of color DC plasma display panel 400.

Conventional DC plasma display panels typically utilize the abnormal glow or normal glow regions of a DC glow discharge at or below 400 Torr gas pressure. At these pressures, conventional color DC plasma display panels exhibit poor luminous efficiency and typically have low display lifetimes due to cathode sputtering. One method of improving the lifetime of the DC plasma display panel is to increase the gas pressure in the glow discharge. However, this typically causes more current to flow in the discharge cell, reducing the self-stabilizing function of the glow discharge. To reduce the discharge current at the increased gas pressures, resistors are used to limit the current flow in the discharge cells. As shown in FIG. 4, this is a well known method of creating color DC plasma display panels. However, for large sized plasma display panels, a large number of resistors (usually several million) are needed to produce a stable operating plasma display panel. Adding these individual resistors decreases the uniformity of the display panel, and complicates the plasma display panel manufacturing process.

SUMMARY OF THE INVENTION

Accordingly, it is an advantage of the present invention to provide a novel color DC plasma display panel which overcomes the shortcomings of the prior art.

Another advantage of the present invention is to provide a DC plasma display panel with holes spaced along the cathode lines for confining the glow discharge of each display cell within the cathode holes.

Yet another advantage of the present invention is to provide a DC plasma display panel which utilizes the abnormal glow region of the glow discharge, thus giving the glow discharge a self-stabilizing function without the need to limit the current within the discharge.

Still another advantage of the present invention is to decrease the cross-talk between adjacent display cells, thereby improving the contrast ratio of the plasma display panel.

Still another advantage of the present invention is to utilize hollow cathode discharge (i.e., a high efficiency discharge which arises from trapped electrons inside the hollow cathode) to obtain high luminous efficiency within the display panel.

The above and other advantages of the present invention are carried out in one form by a DC plasma display panel defined by a plurality of display cells or sub-pixels organized in a matrix configuration. The DC plasma display panel comprises a first plate having a first substrate and a plurality of rows of cathodes extending substantially along a length of the substrate. The cathodes include a plurality of holes therein spaced along each cathode row; preferably one hole for each sub-pixel. The first plate further comprises a dielectric layer which covers the first substrate and the plurality of rows of cathodes. The dielectric layer includes a plurality of holes aligned with the holes in the cathodes.

The DC plasma display panel further comprises a second plate having a second substrate and a plurality of rows of anodes extending along the length of the second substrate. In addition, the second plate includes a plurality of barrier ribs extending substantially along the length of the second substrate, parallel with the plurality of rows of anodes. The barrier ribs form channels on the second substrate and at least one of the rows of anodes is positioned within each channel formed by the barrier ribs. One or more phosphor layers are deposited in the channels.

The DC plasma display panel is formed by combining the first plate and the second plate such that the barrier ribs on the second substrate of the second plate are touching or are in substantial touching proximity with the dielectric layer on the first substrate of the first plate. In addition, the first plate and the second plate are aligned so that the channels formed by the barrier ribs and the rows of anodes on the second substrate run substantially orthogonal to the rows of cathodes on the first substrate. The display cells of the DC plasma display panel are formed at locations proximate where the channels and the rows of anodes cross the rows of cathodes, and more particularly where the rows of anodes cross the holes in the cathodes.

BRIEF DESCRIPTION OF THE DRAWINGS

A more complete understanding of the present invention may be derived by referring to the detailed descriptions and claims when considered in connection with the figures, wherein like reference numbers refer to similar items throughout the figures, and:

FIG. 1 is a perspective side view of a prior art surface discharge type AC plasma display panel;

FIG. 2 is a side view of a prior art opposed discharge type AC plasma display panel;

DESCRIPTION OF THE PREFERRED EMBODIMENT

The present invention is a novel color DC plasma display panel and method for making the same. In the figures, similar components and/or features have the same reference label. Various components of the same type are distinguished by following the reference labeled by a dash and a second label that distinguishes among the similar components. If only the first reference label is used, the description is applicable to any one of the several similar components.

Figure 3:
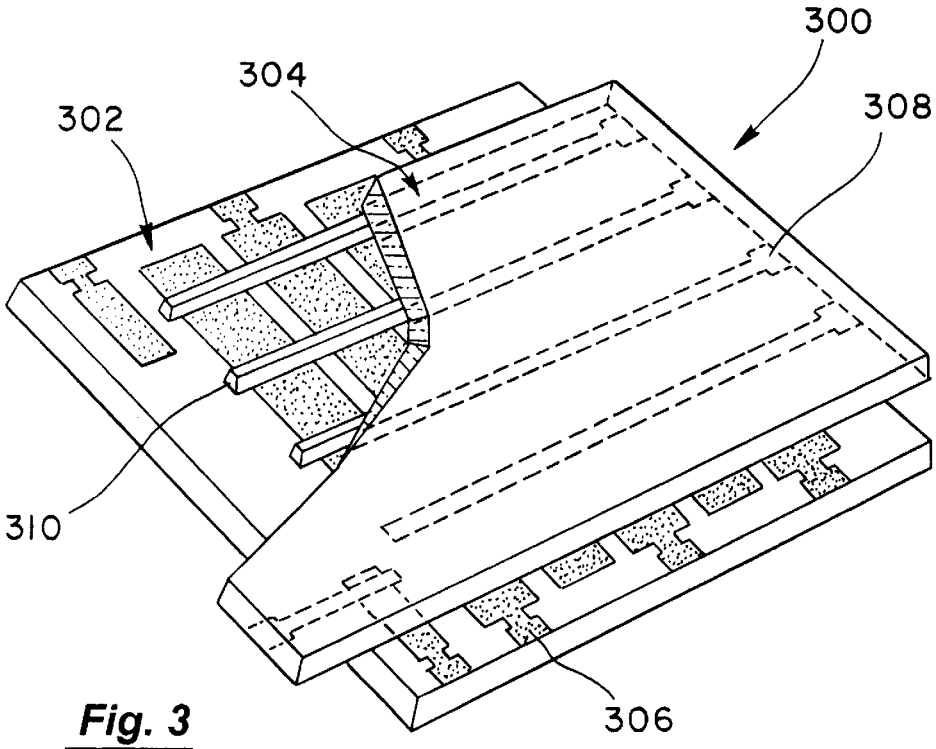
Fig. 3 ( Prior Art )
FIG. 3 is a top perspective view of a prior art monochrome DC plasma display panel.
Figure 4:
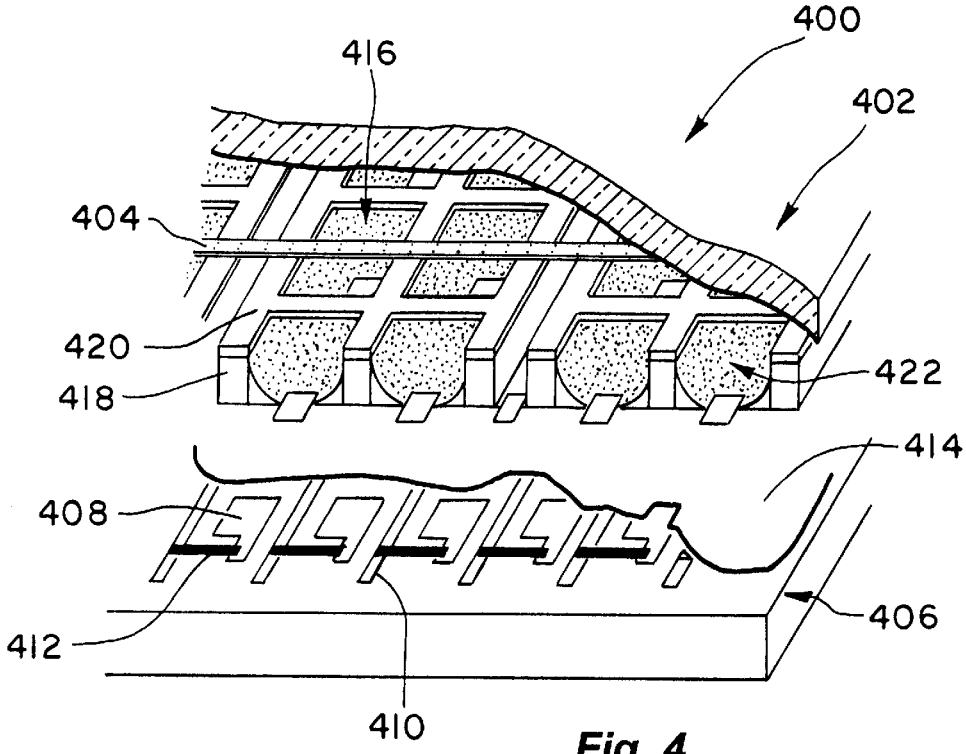
Fig. 4 ( Prior Art )
FIG. 4 is a perspective side view of a prior art color DC plasma display panel.
Figure 5:
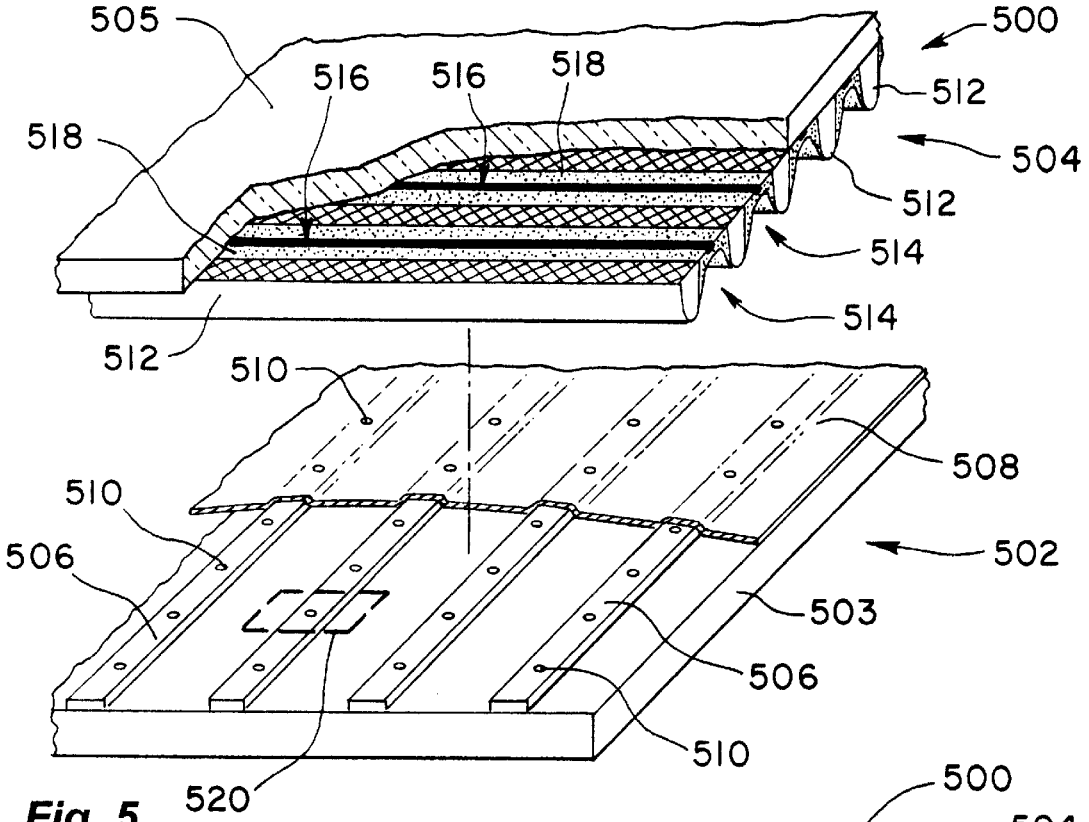
FIG. 5 is a perspective side view of a first embodiment of a DC plasma display panel in accordance with the present invention.

Referring now to FIG. 5, a first embodiment of a color DC plasma display panel (PDP) 500 in accordance with the present invention is illustrated. PDP 500 suitably comprises a first plate 502 and a second plate 504. First plate 502 preferably comprises a glass-type substrate 503 and includes a plurality of rows of cathodes 506 extending substantially along a length of first plate 502. An insulating dielectric layer 508 covers first plate substrate 503 and cathodes 506. Dielectric material 508 may comprise any suitable dielectric material, such as silicon dioxide ($SiO_2$), silicon nitride ($Si_3N_4$), and tantalum pentaoxide ($Ta_2O_5$), and thick film dielectric to name a few.

In addition, a plurality of holes 510 extend through dielectric layer 508 and rows of cathodes 506. In accordance with this aspect of the invention, holes 510 preferably are equally spaced along each cathode row 506. The location and/or separation of holes 510 on cathode rows 506 will vary depending on the size of the display panel.

Holes 510 may be any size and shape. In accordance with the preferred embodiment of the invention, holes 510 are cylindrical in shape, having a diameter in the range of about 10 μm to about 200 μm and preferably about 25 μm. Holes 510 preferably extend through dielectric layer 508 and may extend either part way or completely through cathodes 506. In accordance with a preferred embodiment of the invention, the depths of holes 510 preferably are in the range of about 10 μm to about 200 μm.

Like first plate 502, second plate 504 preferably comprises a glass-like substrate 505. Formed on second plate 504, and more specifically on substrate 505 is a plurality of barrier ribs which extend substantially along a length of the second plate. Adjacent barrier ribs 512 form a plurality of channels 514 on the second plate 504. Within each channel 514 is at least one anode 516 running substantially along the entire length of channel 514. In addition, a phosphor layer 518 is formed in each channel 514. Phosphor layers 518 may be red, green or blue phosphor layers and preferably alternate colors within each channel 514. That is, one channel 514 will have a red phosphor layer, the next adjacent channel 514 will have a green phosphor layer, the next adjacent channel 514 will have a blue phosphor layer, the next adjacent channel 514 will have a red phosphor layer, and so on. However, as one skilled in the art will appreciate, the particular order of the phosphor layers in channels 514 may vary. As discussed in more detail below, by exciting the adjacent sub-pixel cells with the different phosphor colors to different and varying intensities, the combination of the colors at the different intensities in the adjacent cells will create a wide range of colors. Typically about 256 or more different color variations can be achieved.

To form plasma display panel 500, first plate 502 and second plate 504 are combined, so that barrier ribs 512 on second plate 504 are touching or are close to touching dielectric layer 508 on first plate 502. In accordance with this aspect of the invention, first plate 502 and second plate 504 are aligned such that barrier ribs 512 and anodes 516 run substantially orthogonal to cathodes 506. In this manner, display cells or sub-pixels 520 are defined within channels 514 at locations where anodes 516 cross cathodes 506, and more particularly, where anodes 516 cross over or near holes 510 in cathodes 506.

Figure 6:
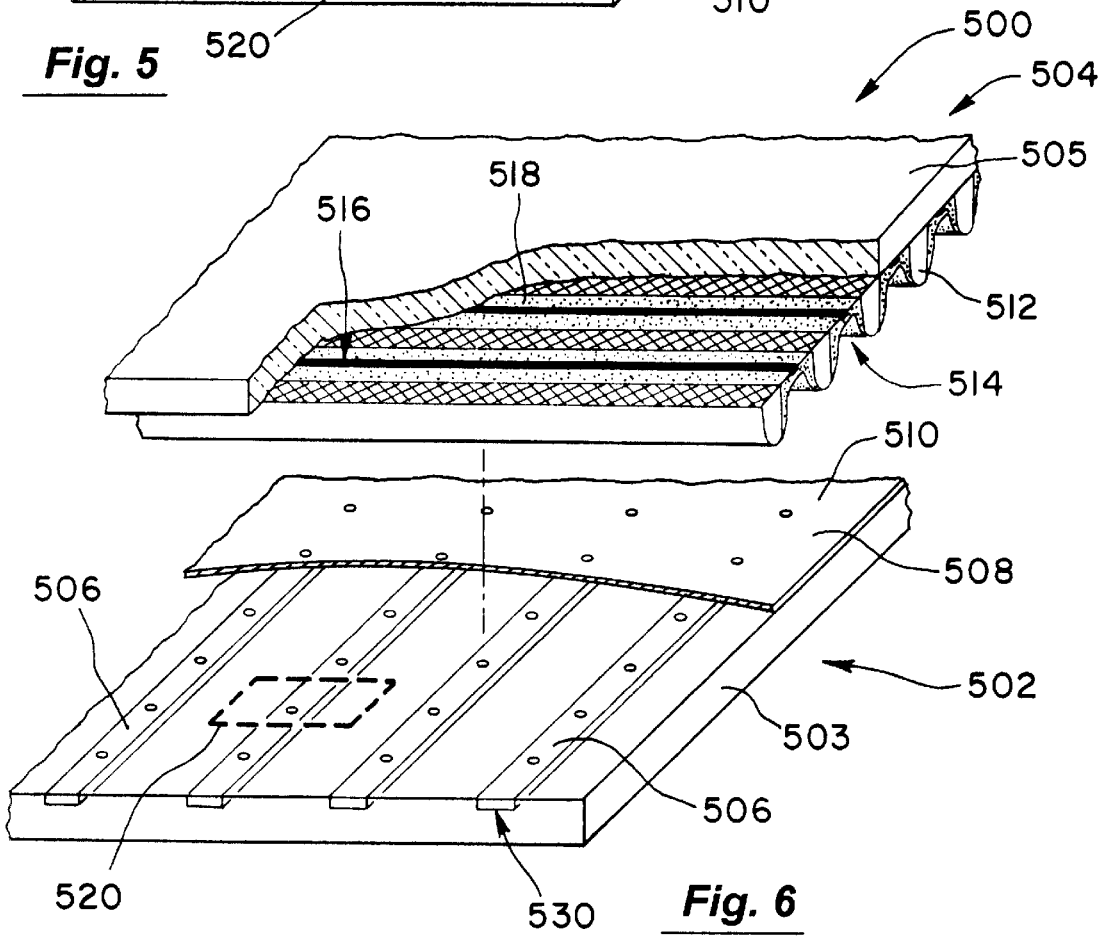
FIG. 6 is a perspective side view of a second embodiment of a DC plasma display panel in accordance with the present invention.

As illustrated in FIG. 5, cathodes 506 are formed on top of substrate 503 of first plate 502 creating ridges thereon. In accordance with another embodiment of the present invention, as shown in FIG. 6, cathodes 506 may be formed within grooves 530 which are created in substrate 503 of first plate 502. In accordance with this embodiment of the invention, the top of cathode rows 506 preferably will be substantially flush with the top surface of first plate substrate 503, eliminating the cathode ridges. In this regard, dielectric layer 508 will be deposited on a flat rather than a ridged surface, enabling the dielectric layer itself to be flat.

Figure 7:
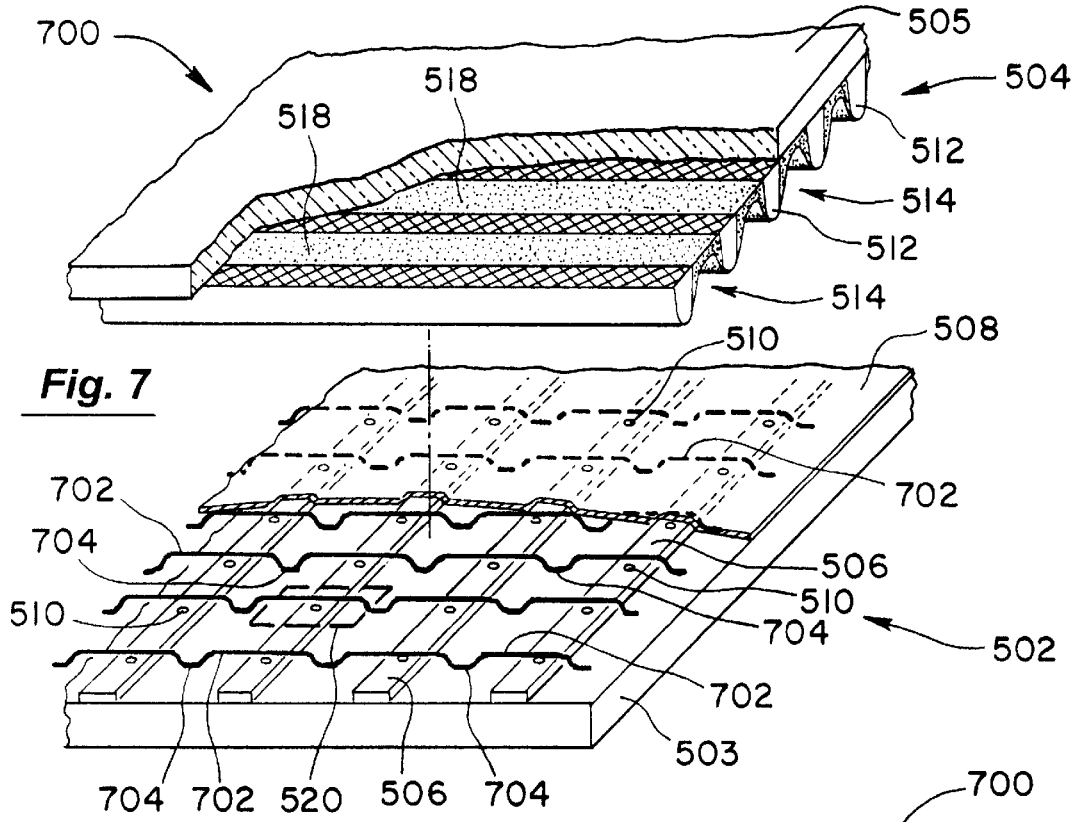
FIG. 7 is a perspective side view of a third embodiment of a DC plasma display panel in accordance with the present invention.
Figure 8:
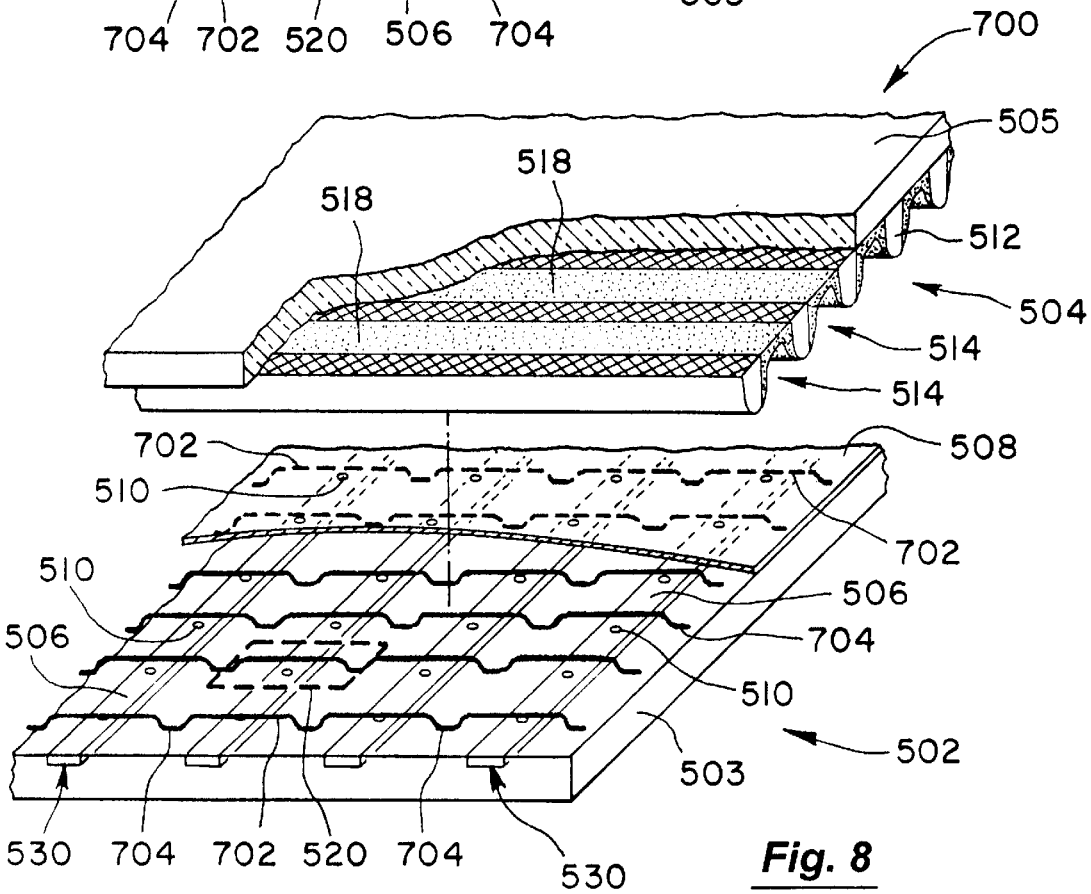
FIG. 8 is a perspective side view of a fourth embodiment of a DC plasma display panel in accordance with the present invention.

Referring now to FIGS. 7 and 8, yet another embodiment of the present invention is shown. In accordance with this embodiment of the invention, instead of second plate 504 having rows of anodes 516 formed in channels 514 between barrier ribs 512, bridge anodes 702 preferably are formed on first plate 502. In accordance with this aspect of the invention, bridge anodes 702 preferably are formed orthogonal to cathode rows 506 and are formed over or in close proximity to each hole 510 in the cathode rows. In this manner, the plasma discharge in each sub-pixel of plasma display panel 700 is formed between a bridge anode 702 and a hole 510 in a cathode 506. More specifically, as discussed in more detail below, the plasma discharge is formed within each hole 510 in dielectric layer 508 and cathode 506.

As illustrated in FIGS. 7 and 8, each end of each bridge anode 702 is preferably formed on and attached to a metal post 704. Post 704 preferably is formed on top of substrate 503 of first plate 502. As with plasma display panel 500, plasma display panel 700 is formed by combining first plate 502 and second plate 504 so that barrier ribs 512 on second plate 504 are touching or close to touching dielectric layer 508 on first plate 502. The first plate 502 and second plate 504 are aligned such that bridge anodes 702 are aligned within channels 514 between barrier ribs 512. As mentioned briefly above, sub-pixels 520 are defined within channels 514 at locations where bridge anodes 712 cross cathodes 506, and more particularly, where bridge anodes 712 cross holes 510 and cathodes 506. A more detailed discussion of various methods of making DC plasma display panel 700 and, in particular post 704 and bridge anode 702 is discussed in more detail below.

Figure 9:
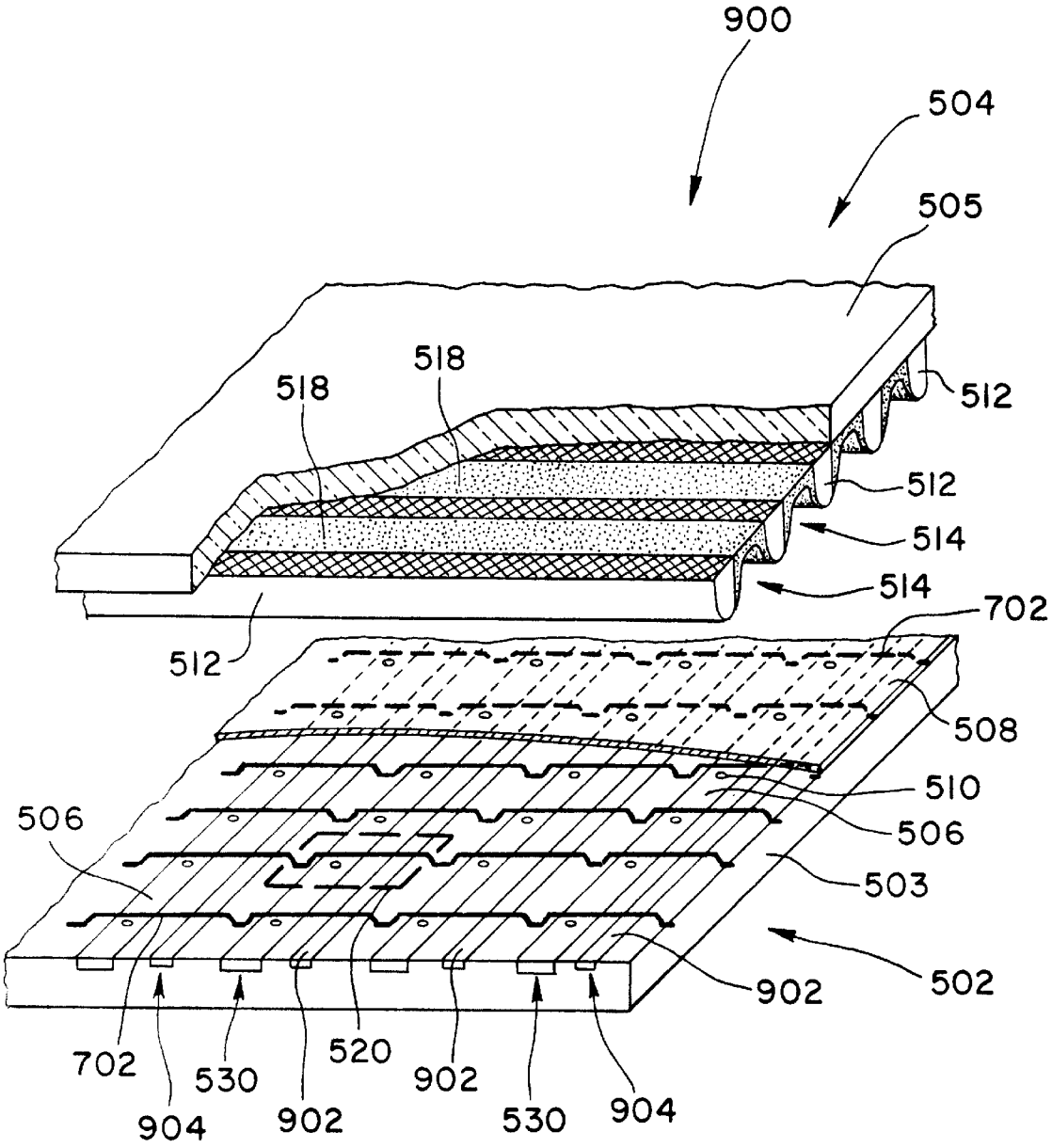
FIG. 9 is a perspective side view of a fifth embodiment of a DC plasma display panel in accordance with the present invention.

Referring now to FIG. 9, yet another embodiment of the present invention is shown. In particular, DC plasma display panel 900 is similar to DC plasma display panel 700 illustrated in FIGS. 7 and 8, except that DC plasma display panel 900 further includes a plurality of rows of priming cathodes 902 extending substantially along substrate 503 of first plate 502, substantially parallel to and next to cathode rows 506. As with cathodes 506, priming cathodes 902 can be formed on top of substrate 503 of first plate 502, or priming cathodes 904 can be formed in grooves 904 within the substrate.

Priming cathodes 902 can be configured for both AC and DC priming. For AC priming, dielectric layer 508 preferably covers each of the rows of priming cathodes 902. As one skilled in the art will appreciate, when an AC voltage source is applied to one or more of priming cathodes 902, an AC plasma discharge is created between priming cathode 902 and a bridge anode 702. This AC priming discharge typically is used to more quickly start the DC plasma discharge within a particular cell by reducing the break-down voltage necessary for creating the DC plasma discharge. Accordingly, a display cell can be more quickly illuminated because the build-up or delay time for that particular cell is reduced.

For DC priming, dielectric layer 508 preferably is opened-up or removed at the location where bridge anode 702 crosses priming cathode 902. In this manner, when a DC voltage signal is applied to a particular priming cathode 902 associated with a particular bridge anode 702, a DC priming discharge is created at the location where bridge anode 702 crosses the exposed priming cathode 902. As with the AC priming discharge, the DC priming discharge reduces the discharge build-up time for the main DC discharge cell, thus reducing the delay time of the cell.

While priming cathodes 902 are illustrated in FIG. 9 as being applied to an embodiment of the present invention having bridge anodes 702, one skilled in the art will appreciate that both AC and DC priming cathodes may be utilized with the embodiments illustrated in FIGS. 5 and 6; i.e., where anodes 516 are formed in channels 514 between barrier ribs 512. Thus, the present invention is not limited to the illustrated embodiment of FIG. 9.

Referring again to FIGS. 5 and 6, a method for fabricating color DC plasma display panel 500 will be described. In particular, as mentioned briefly above, first plate 502 suitably comprises a substrate material 503 such as a glass material. Cathode rows 506 may be formed on substrate 503 or within grooves 530 formed in substrate 503 (see FIG. 6). A number of different metal deposition techniques may be used to form cathodes 506; for example, metal sputtering, etched metal, bulk wire deposition, electron beam evaporation, thermal evaporation, tungsten CVD, screen printing technique, electro-plating, electroless-plating, photosensitive paste technique, and screen printing and sandblasting technique may be used. Such metal deposition techniques are well known in the art and thus, for clarity purposes, will not be described in more detail. For a more detailed discussion of these and other metal deposition techniques, see for example, S.M. Sze, *VLSI Technology* (McGraw Hill 2nd ed.) and Kapakjian, *Manufacturing Engineering and Technology*, (Addison Wesley, 3rd ed.), both of which are incorporated herein by reference.

After cathode rows 506 are formed on substrate 503, a dielectric layer 508 is formed on substrate 503 and cathodes 506. Dielectric layer 508 may comprise any suitable dielectric layer such as, for example, silicon dioxide ($SiO_2$), silicon nitride ($Si_3N_4$), and tantalum pentaoxide ($Ta_2O_5$), to name a few. Dielectric layer 508 may be formed on substrate 503 and cathodes 506 by a number of different deposition techniques. For example, dielectric sputtering, chemical vapor deposition (CVD), plasma enhanced CVD, low pressure CVD, screen printing technique, electron beam evaporation, and thermal evaporation can be used. For a more detailed discussion of these deposition techniques, see for example, S. M. Sze, VLSI Technology.

After dielectric layer 508 is deposited on substrate 503, holes 510 preferably are formed in dielectric layer 508 and cathodes 506. Holes 510 may be formed by a number of different techniques, such as, for example, photolithography and chemical etching, photolithography and plasma etching, laser drilling, or reverse plating and sandblasting. As one skilled in the art will appreciate, the photolithography and chemical or plasma etching processes typically comprise placing a photoresist mask on dielectric layer 508. Portions of the photoresist mask are removed using photolithography at the locations where holes 510 are to be formed. Then, an etching process (chemical or plasma) is used to remove dielectric layer 508 and the metal of cathode 506 at the locations where the photoresist mask has been removed. Finally, the photoresist mask is removed, leaving dielectric layer 508 and cathodes 506 with holes therein. For a more detailed discussion of the photolithography and etching processes, see John L. Vossen et al. *Thin Film Processes* (Academic Press), which is incorporated herein by reference.

Second plate 504 preferably comprises a glass-type substrate 505 as shown in FIGS. 5 and 6. Deposited on substrate 505 is a plurality of rows of metal anodes 516. Anodes 516 may be formed on substrate 505 using any number of different metal deposition techniques. For example, the same techniques used to form cathodes 506 may be used to form anodes 516. After the formation of anode rows 516, barrier ribs 512 preferably are formed on substrate 505. Barrier ribs 512 are located on substrate 505 such that the barrier ribs separate anode rows 516 from one another. In accordance with this aspect of the invention, barrier ribs 512 may be formed by a number of different fabrication techniques, such as screen printing, dry film resistor and photolithography, photosensitive paste and photolithography, and sandblasting. The formation of barrier ribs 512 creates a plurality of channels 514 on substrate 505 within which anodes 516 reside.

After barrier ribs 512 are formed on substrate 505, phosphor layers 518 are deposited in each channel 514 between barrier ribs 512. Preferably, one of a blue, red or green phosphor is deposited on the sides of the barrier ribs 512 as well as on substrate 505. The different colored phosphors are alternated in each channel 514; for example, one channel will have a red phosphor deposited therein, the next adjacent channel will have a green phosphor, the next adjacent channel will have a blue phosphor, and then the sequence is repeated. Phosphor layers may be deposited using any number of different deposition techniques including screen printing, electron beam evaporation, and sandblasting technique, to name a few.

After the formation of second plate 504, first plate 502 and second plate 504 are combined so that barrier ribs 512 on second plate 504 are touching or are in substantial touching proximity with substrate 508 on first plate 502. The two plates are aligned such that barrier ribs 512 and anodes 516 run substantially orthogonal to cathodes 506 on first plate 502. Each individual sub-pixel 520 is formed at a location where anode rows 516 cross cathode rows 506 and, more particularly, where anode rows 516 cross over or near holes 510 formed in cathode rows 506.

As illustrated in FIGS. 5 and 6 and discussed briefly above, cathode rows 506 may be formed on substrate 503 of first plate 502, or cathode rows 506 may be formed within grooves 530 in substrate 503. In accordance with this aspect of the invention, grooves 530 may be formed in substrate 503 by a number of different fabrication techniques, including photolithography and chemical etching, and diamond sawing to name a few. After grooves 530 are formed, metal cathode rows 506 are deposited into grooves 530 using one of the metal deposition techniques discussed above. Finally, dielectric layer 508 is deposited on substrate 503 and cathodes 506 using any one of a variety of dielectric layer deposition processes.

While the method of fabricating DC plasma display panel 500 is described herein in a particular order, one skilled in the art will appreciate that many of the steps of the fabrication process may be interchanged and performed in a different order. Therefore, the method of making DC plasma display panel 500 is not limited to the particular order of steps disclosed herein.

Referring now to FIGS. 7 and 8, methods for fabricating DC plasma display panel 700 will be discussed. As with DC plasma display panel 500 illustrated in FIGS. 5 and 6, DC plasma display panel 700 comprises a first plate 502 including a glass substrate 503, and a second plate 504 including a glass substrate 505. In accordance with this embodiment of the invention, second plate 504 is formed in the same manner as discussed above with reference to DC plasma display panel 500 in FIGS. 5 and 6, except anodes 516 are not formed on substrate 505. Instead, bridge anodes 702 are formed on first plate 502 as discussed in detail below. The above discussion of the formation of the second plate 504 also applies to DC plasma display panel 700 except, of course, the step of forming anodes 516 on second plate 504 is not performed. The formation of first plate 502 of DC plasma display panel 700 is as follows. First, cathode rows 506 are formed either on substrate 503 or within grooves 530 formed in substrate 503. Next, a dielectric layer 508 is deposited on substrate 503 covering cathodes 506, and then holes 510 are formed in dielectric layer 508 and cathode rows 506. The formation of cathode rows 506, dielectric layer 508 and holes 510 are discussed in detail above with reference to FIGS. 5 and 6.

As one skilled in the art will appreciate, a number of different methods may be used to form bridge anodes 702 and posts 704.

In accordance with first method for forming bridge anodes 702 and posts 704 a thin film technique including photolithography, metal deposition and etching processes preferably is used. In particular, after holes 510 are formed in dielectric layer 508 and cathodes 506, a first photoresist material is deposited on substrate 503. The photoresist material preferably covers dielectric layer 508, and a photolithography process is used to expose areas of the dielectric layer 508 on which post sites 706 are to reside.

Next, a seed layer comprising a thin metal film, such as aluminum, or titanium/tungsten is deposited on the surface of the first photoresist material, including the exposed areas of the dielectric layer, forming post sites 706 (not shown in the Figures). Any of the metal deposition techniques discussed above or known in the art may be used to form post sites 706. As discussed below, the first photoresist layer typically is not removed until later in the process.

After post sites 706 are defined on dielectric layer 508, bridge anodes 702 and posts 704 preferably are formed. In accordance with this aspect of the invention, a second photoresist layer is deposited on the metal seed layer, and photolithography is used to expose the metal seed layer at the locations where bridge anode 702 and posts 704 are to be formed. The second photoresist layer still remaining on substrate 503 and, in particular, on the seed layer, acts as a mold for forming bridge anodes 702 and posts 704. Next, the bridge anode and post metal is deposited on the exposed seed layers within the mold or channels formed in the photoresist. Any method of metal deposition may be used. After the bridge anode and post metal has been deposited on the exposed seed layer, an etching process, for example chemical or plasma etching, is used to remove the remaining first and second photoresist materials, as well as the seed layer residing between the two photoresist layers. However, the seed layer which forms post sites 706 remains between posts 704 and dielectric layer 508. Upon removal of the photoresist materials and the seed layer, bridge anode 702 and post 704 are formed and are directly bonded to post sites 706.

A second method which may be used to form bridge anodes 702 on first plate 502 is a wire bonding and thermal compression technique. In accordance with this aspect of the invention, post sites 706 and posts 704 are formed on dielectric layer 508 residing on substrate 503 using the same technique as described above to form bridge anodes 702 and posts 704. However, as one skilled in the art will appreciate, in accordance with this fabrication method, only posts 704 are formed, not bridge anodes 702. Next, bridge anode wires are bent and formed into their proper shape, and then placed on substrate 503, and in particular, on posts 704 formed on substrate 503. Finally, a thermal compression or thermal sonic bonding method is used to bond the bridge anode wires to posts 704. Thermal sonic and thermal compression techniques are well known in the art and, thus, will not be discussed in detail herein.

A third method which may be used to form bridge anodes 702 comprises a screen printing and dry film technique. In accordance with this aspect of the invention, a dry film is first deposited on dielectric layer 508 and post sites 706. Next, the dry film is etched above each of the post sites 706.

Apart from the plasma display panel, a screen printing technique is used to form a pattern or mold for the bridge anodes 702 and posts 704. Preferably, the screen printing mask is made of a stainless steel or silk material. Next, a metal paste, such as aluminum, nickel, silver or the like, is deposited using a screen printing to form bridge anodes 702 and posts 704. The metal paste is then heated in an oven at a temperature of about 80° Celsius to about 150° Celsius and preferably about 120° Celsius. The heating process burns out the binder in the metal paste, hardening the metal paste into a solid metal form. Next, the hardened bridge anodes 702 and posts 704 are placed on substrate 503, and specifically on post sites 706. The dry film, photoresist, and metal seed layer previously deposited on the substrate is then etched away using chemical or plasma etching, and the metal paste is again fired, preferably at a temperature between about 500° Celsius and about 600° Celsius, and more preferably about 580° Celsius. This second firing or cooking process cures the metal and helps bond posts 704 and post sites 706 to the glass or dielectric layer.

While various different methods of forming bridge anodes 702 are disclosed herein, one skilled in the art will appreciate that any number of methods for forming bridge anodes 702 may be used. Thus, the present invention is not limited to the particular methods disclosed herein.

After bridge anodes 702 are formed on first plate 502, the two plates 502, 504 are combined, so that the lines or rows of bridge anodes 702 reside within channels 514 formed between barrier ribs 512. In this manner, the DC discharge is generated between cathodes 506 and bridge anodes 702 within channels 514. The plasma discharges will illuminate the phosphor within channels 514, causing that particular one hole to generate a color sub-pixel.

Referring now to FIG. 9, a method for fabricating DC plasma display panel 900 will be discussed. In particular, DC plasma display panel 900 preferably is formed in the same manner as DC plasma display panel 700 as illustrated in FIGS. 7 and 8, except that a plurality of rows of priming cathodes 902 are formed on substrate 503 of first plate 502. As with cathode rows 506 and posts 704, priming cathodes 902 may be formed on substrate 503 or within grooves 904 which are formed within substrate 503. The formation of grooves 904 may be performed by a number of different processes including chemical etching and diamond sawing. Similarly, priming cathodes 902 may be formed on substrate 503 or within grooves 904 using any number of different metal deposition techniques, including the ones discussed above.

In operating any of the color DC plasma display panels illustrated in FIGS. 5–9, a DC pulse voltage is supplied to one or more anode and cathode line pairs. Preferably, the DC voltage is in the range of about 200v to about 400v. The DC voltage signals cause a DC plasma discharge to form at the cross point of the anode and cathode pair. Each cross point defines a particular sub-pixel. In accordance with the present invention, because dielectric layer 508 and cathodes 506 include holes 510 therein, the DC plasma discharge in each display cell is confined within the holes. This prevents the plasma discharge from spreading along the cathode row, giving several advantages.

First, by confining the discharge within the cathode holes and preventing the discharge from spreading along the cathodes into adjacent display cells, the crosstalk between adjacent display cells is significantly reduced. This reduction of cross-talk between display cells greatly improves the contrast ratio of the plasma display panel as a whole.

A second advantage of the configurations of the DC plasma display panels of the present invention is that by confining the DC plasma discharge within holes 510 in cathodes 506, the total current flowing into each display cell is limited, thus confining the DC discharge within the abnormal glow region for the particular DC voltages applied to the display panel. By keeping the discharge within the abnormal glow region, the discharge maintains a positive I–V (current-voltage) slope, making the display cells self-stabilizing without needing a current limiting resistor.

Figure 10:
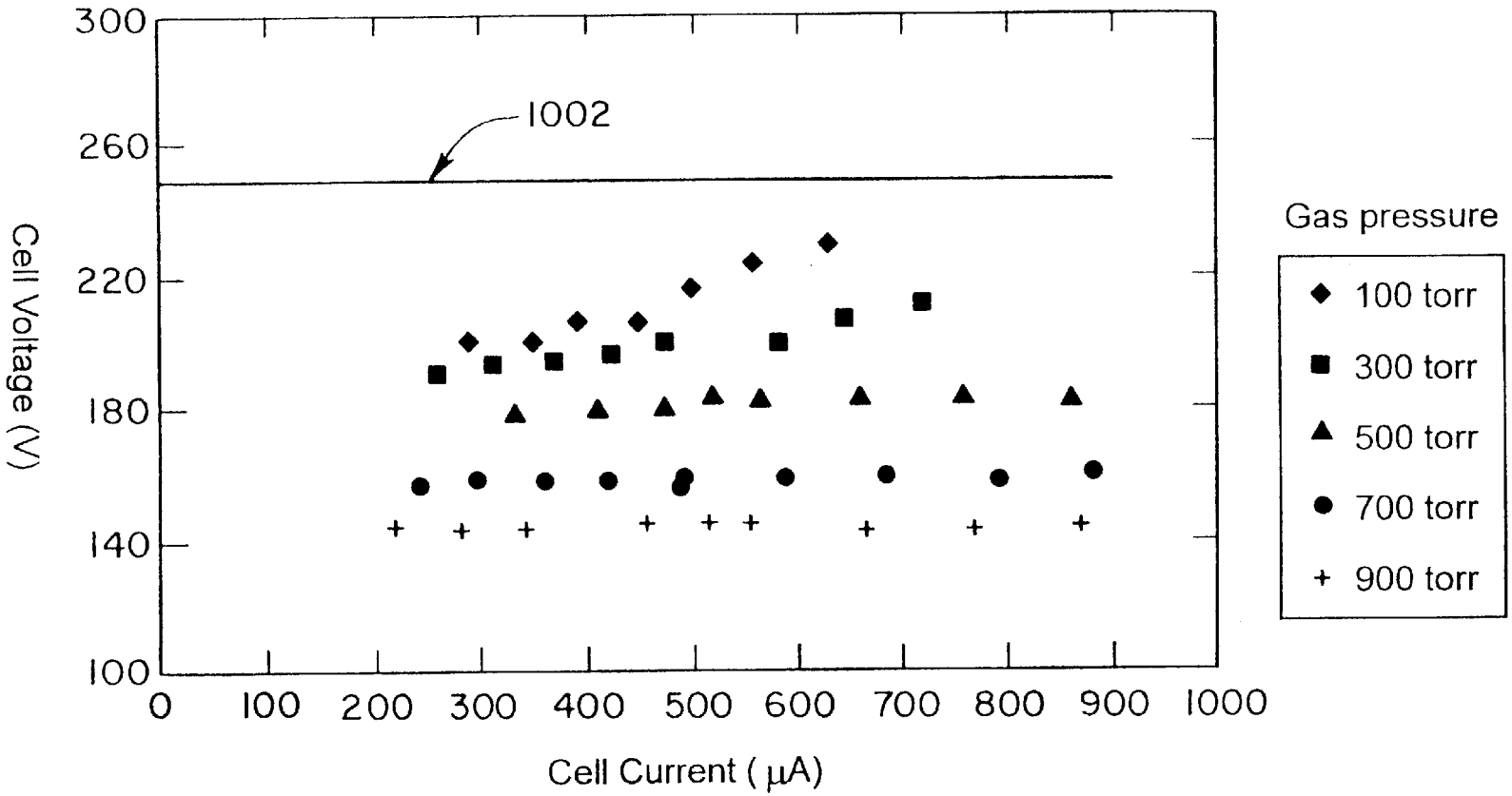
FIG. 10 shows a graph of various i-v curves for DC plasma discharges at varying pressures produced by conventional DC plasma display panels not having a current limiting resistor.

Typically, the I–V (current-voltage) slope within a particular glow discharge decreases with the increase of gas pressure. FIG. 10 shows how the particular I–V slopes for discharges at different gas pressures decrease as the gas pressures increase. In most DC plasma discharges, the discharges operate where the I–V curve meets the load line. As shown in FIG. 10, if a current limiting resistor is not used (i.e., the load line 1002 equals zero ohms), the I–V curve never meets or crosses the load line, or at best meets the load line 1002 at a high current level. Thus, the DC plasma discharge fails without a resistor. However, as illustrated in FIG. 11, by confining the DC glow discharges within holes 510, the I–V curve meets or crosses the load line 1002, at the lower current level, even when no additional load is added, i.e., no current limiting resistor is added.

Figure 11:
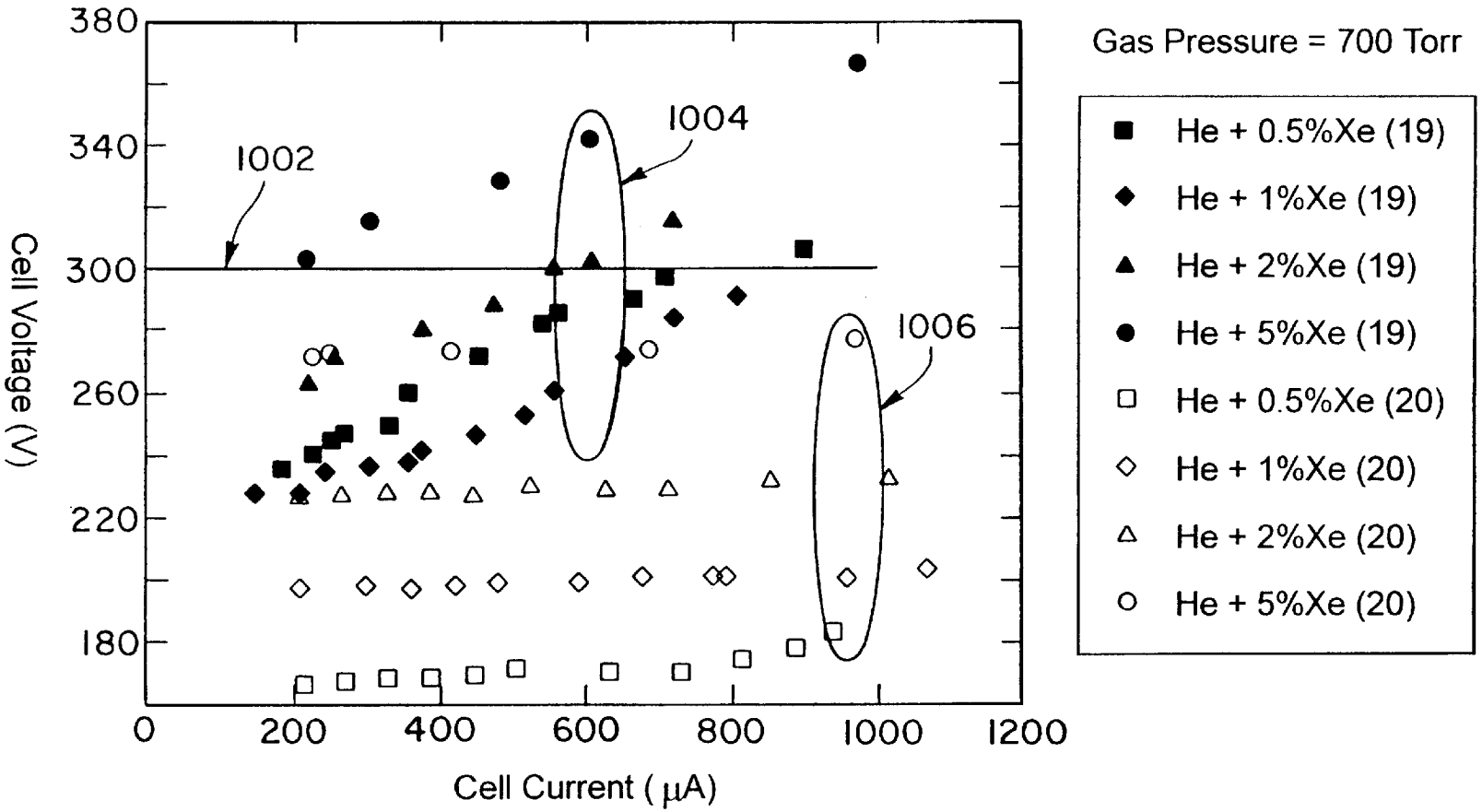
FIG. 11 shows a graph of various i-v curves for DC plasma discharges at 700 Torr for a conventional DC plasma display panel and a DC plasma panel of the present invention.

FIG. 11 shows a comparison of I–V curves for plasma display discharges utilizing holes in the cathodes in accordance with the present invention with the I–V curves of plasma discharges of conventional DC plasma display panels. As can be seen in FIG. 11, at a gas pressure of 700 Torr, the I–V curves of the plasma discharges utilizing holes in the cathodes crosses the load line 1002 at a relatively low current value, i.e., approximately between 0 and 700 microamps (see the area 1004). On the other hand, the I–V curves of the plasma discharges at 700 Torr for conventional DC plasma display panels never meet the load line 1002 (see area 1006).

Thus, with conventional DC plasma display panels, a stable discharge cannot be reached without adding current limiting resistors.

In conclusion, the present invention provides a novel design for a color DC plasma display panel and methods for making the same. While a detailed description of presently preferred embodiments of the invention have been given above, various alternatives, modifications, and equivalents will be apparent to those skilled in the art. For example, while a number of different plasma display panel fabrication techniques are disclosed hereinafter developed fabrication technique, either known or hereinafter developed, may be used to make the plasma display panels of the present invention without varying from the spirit of the invention. Therefore, the above description should not be taken as limiting the scope of the invention which is defined by the appended claims.

What is claimed is:

1. A DC plasma display panel comprising a plurality of display cells defined therein and organized in a matrix configuration, said display panel comprising:

a first plate, comprising;

a first substrate;

a plurality of rows of cathodes extending substantially along a length of said first substrate, and comprising a plurality of holes therein spaced along said rows; and a dielectric layer covering said first substrate and said plurality of rows of cathodes, and comprising a plurality of holes therein, said holes being configured to align with the holes in said plurality of rows of cathodes; and a second plate, comprising;

a second substrate;

a plurality of rows of anodes extending substantially along a length of said second substrate;

a plurality of barrier ribs extending substantially along a length of said second substrate, substantially parallel with said plurality of rows of anodes, wherein any two adjacent barrier ribs form a channel on said second substrate, such that said plurality of barrier ribs form a plurality of channels, and wherein at least one of said rows of anodes is positioned in at least one of said channels; and at least one phosphor layer deposited in at least one of said channels;

wherein said DC plasma display panel is formed by combining said first plate with said second plate such that said barrier ribs on said second substrate of said second plate are in substantial touching proximity with said dielectric layer on said first substrate of said first plate, and wherein said channels formed by said barrier ribs and said rows of anodes on said second substrate run substantially orthogonal to said rows of cathodes on said first substrate, such that display cells are formed in said DC plasma display panel at locations proximate where said channels and said rows of anodes cross said rows of cathodes, creating said matrix of display cells.

2. The DC plasma display panel as recited in claim 1 wherein said plurality of rows of cathodes are formed on said first substrate.

3. The DC plasma display panel as recited in claim 1 wherein a plurality of grooves are formed in said first substrate and said rows of cathodes are formed in said grooves.

4. The DC plasma display panel as recited in claim 1 further comprising a plurality of rows of priming cathodes running substantially parallel with said rows of cathodes and extending substantially along the length of said first substrate.

5. The DC plasma display panel as recited in claim 4 wherein said plurality of rows of priming cathodes are formed on said first substrate.

6. The DC plasma display panel as recited in claim 4 wherein a plurality of grooves are formed in said first substrate and said rows of priming cathodes are formed in said grooves.

7. The DC plasma display panel as recited in claim 4 wherein said priming cathodes are configured to support DC priming.

8. The DC plasma display panel as recited in claim 4 wherein said priming cathodes are configured to support AC priming.

9. A DC plasma display panel comprising a plurality of display cells defined therein and organized in a matrix configuration, said display panel comprising:

a first plate, comprising;

a first substrate;

a plurality of rows of cathodes extending substantially along a length of said first substrate, and comprising a plurality of holes therein spaced along said rows;

a dielectric layer covering said first substrate and said plurality of rows of cathodes, and comprising a plurality of holes therein, said holes being configured to align with the holes in said plurality of rows of cathodes; and a plurality of rows of bridge anodes formed on said first plate and configured to run substantially orthogonal to said rows of cathodes; and a second plate, comprising;

a second substrate;

a plurality of barrier ribs extending substantially along a length of said second substrate, wherein any two adjacent barrier ribs form a channel on said second substrate, such that said plurality of barrier ribs form a plurality of channels; and at least one phosphor layer deposited in at least one of said channels;

wherein said DC plasma display panel is formed by combining said first plate with said second plate such that said barrier ribs on said second substrate of said second plate are in substantial touching proximity with said dielectric layer on said first substrate of said first plate, and wherein said channels formed by said barrier ribs run substantially parallel with said bridge anodes and substantially orthogonal to said cathodes on said first plate, such that said channels substantially align with said rows of bridge anodes, and display cells are formed in said DC plasma display panel at locations proximate where said channels cross said cathodes, creating said matrix of display cells.

10. The DC plasma display panel as recited in claim 9 wherein said plurality of rows of cathodes are formed on said first substrate.

11. The DC plasma display panel as recited in claim 9 wherein a plurality of grooves are formed in said first substrate and said rows of cathodes are formed in said grooves.

12. The DC plasma display panel as recited in claim 9 further comprising a plurality of rows of priming cathodes running substantially parallel with said rows of cathodes and extending substantially along the length of said first substrate.

13. The DC plasma display panel as recited in claim 12 wherein said plurality of rows of priming cathodes are formed on said first substrate.

14. The DC plasma display panel as recited in claim 12 wherein a plurality of grooves are formed in said first substrate and said rows of priming cathodes are formed in said grooves.

15. The DC plasma display panel as recited in claim 12 wherein said priming cathodes are configured to support DC priming.

16. The DC plasma display panel as recited in claim 12 wherein said priming cathodes are configured to support AC priming.

17. The DC plasma display panel as recited in claim 9 wherein said bridge anodes are supported by posts formed on said first substrate.

* * * * *